United States Patent [19]

Ogasawara

[11] 4,128,964

[45] Dec. 12, 1978

[54] TRANSFER MECHANISM INTENDED FOR USE IN TOYS

[75] Inventor: Toyotsugu Ogasawara, Tokyo, Japan

[73] Assignee: Tomy Kogyo Co., Inc., Tokyo, Japan

[21] Appl. No.: 814,228

[22] Filed: Jul. 11, 1977

[30] Foreign Application Priority Data

Jul. 16, 1976 [JP] Japan ..... 51/95487

[51] Int. Cl.[2] ..... A63H 33/00

[52] U.S. Cl. ..... 46/43; 46/40; 46/122; 46/202; 187/24; 272/7

[58] Field of Search ..... 46/43, 40, 202, 258, 46/261, 1 K, 122; 187/24; 272/6, 7

[56] References Cited

U.S. PATENT DOCUMENTS

| | | | |
|---|---|---|---|
| 1,228,162 | 5/1917 | Anderson | 187/24 X |
| 2,742,164 | 4/1956 | Francis | 187/24 X |
| 2,896,802 | 7/1959 | Hope et al. | 46/40 X |
| 3,281,985 | 11/1966 | Einfalt | 46/202 |
| 3,562,950 | 4/1967 | Genin | 46/261 |
| 3,633,308 | 1/1972 | Yang | 46/261 |
| 3,721,035 | 3/1973 | Goldfarb | 46/40 |
| 3,721,036 | 3/1973 | Goldfarb | 46/43 |
| 3,751,849 | 8/1973 | Goldfarb et al. | 46/40 |

*Primary Examiner*—Russell R. Kinsey

*Assistant Examiner*—Mickey Yu

*Attorney, Agent, or Firm*—Edward D. O'Brian

[57] ABSTRACT

A toy in which so-called "ball people"—figurines which are capable of rolling along an inclined surface—are transferred from one location to another in such a way as to amuse a child can be constructed so as to include a composite of several transfer mechanisms serving as a unitary transfer mechanism. The disclosed toy includes a more or less tubular tower which extends upwardly from a base. A threaded shaft extends upwardly through the tower. A carrier is located within the tower and is mounted in such a way that as the shaft is rotated the carrier is capable of lifting a figurine from adjacent to a lower or receiving opening to an upper or discharge opening. An inclined chute is provided on the tower so as to receive such a figurine and transport it to a pickup location. An arm mounted upon the upper end of the shaft carries a holder which is rotatable with respect to the tower. When the holder is opposite the pickup location a figurine at the pickup location is taken onto the holder and is rotated to another location where a trap door in the bottom of the holder is opened so that the figurine can be deposited on a runway from which it can be transported away from the transfer mechanism.

13 Claims, 7 Drawing Figures

TRANSFER MECHANISM INTENDED FOR USE IN TOYS

CROSS-REFERENCE TO RELATED APPLICATIONS

The subject matter of this application is to a degree related to the subject matter of the co-pending Toyotsugu Ogasawara application Ser. No. 759,648 filed Jan. 1, 1977, entitled "TRANSFER MECHANISM INTENDED FOR USE WITH MOVABLE FIGURINES"; and the co-pending Toyotsugu Ogasawara application Ser. No. 802,569 filed June 1, 1977, entitled "TOY FOR LOADING A VEHICLE". The entire disclosures of these two co-pending applications are incorporated herein by reference.

BACKGROUND OF THE INVENTION

The invention set forth in this specification is principally directed toward transfer mechanisms which are useful in moving an article from one location to another. Although such mechanisms are primarily intended for use in toys it is considered that if desired they can be utilized in other different, unrelated applications. Such mechanisms are considered to be particularly desirable for use in toys because of their effectiveness in amusing children when utilized with other known cooperating toy mechanisms.

In considering this application it is to be realized that the toy field is an old, worked-over, somewhat unique field in which amusement and attention-getting values are of primary importance. As the toy field has advanced it has been determined that toys utilizing so-called "ball people" are quite effective in holding the attention of children within a comparatively limited age group. Such "ball people" are articles of figurines which are capable of rolling along an inclined surface through the action of gravity from one location to another.

A number of different toys have been specifically developed for use with these so-called "ball people". In order to achieve effective mental stimulation of a child it is considered desirable to incorporate within toys utilizing these figurines mechanisms which will automatically move the figurines from one location to another in such a way as to hold and attract the interest of a child. A number of such mechanisms have been developed and utilized. In spite of the effectiveness of such prior mechanisms it is considered that there still exists a need for new and improved transfer mechanisms which are primarily useful in transferring "ball people" type figurines in such a way as to stimulate a child's imagination.

SUMMARY OF THE INVENTION

A broad objective of the present invention is to provide transfer mechanisms for fulfilling this need. Another object of the present invention is to provide new and improved transfer mechanisms which are relatively simple, which are comparatively inexpensive to construct, which are effective for their intended utilization, and which are capable of prolonged utilization with a minimum of maintenance. Various further objectives of the invention will be apparent from a careful consideration of the remainder of this specification.

In accordance with this invention these objectives can be achieved by providing a transfer mechanism for use in moving an article from a first location to a second location which comprises: a base, an externally threaded shaft rotatably mounted on the base so as to extend upwardly therefrom, a tower supported on said base so as to extend upwardly therefrom adjacent to the shaft, a carrier for holding the article and for supporting the article as it is moved from the first location to the second location, cooperating guide means on the tower and on the carrier so that during rotation of the shaft the carrier can be elevated along the length of the shaft and can be pivoted with respect to the shaft, the carrier including a thread-like portion capable of fitting against the thread on the shaft, the weight of the carrier being distributed so that the carrier can pivot generally away from the shaft in order to enable the projection to slide downwardly over the thread on the shaft when there is no weight on the carrier and so that the carrier will pivot generally toward the shaft so as to hold the projection in engagement with the shaft when the article is located on the carrier, and power transmission means for use in rotating the shaft operatively connected to the shaft.

In accordance with this invention these objectives can also be achieved by providing a transfer mechanism for use in moving an article from a first location to a second location which comprises: support means, a holder movably mounted on said support means so as to be capable of being moved from adjacent to said first location to adjacent to said second location, said holder being capable of receiving said article when adjacent to said first location, a bottom door located on said holder, latch means located on said holder for use in controlling when said door can be opened, said latch means extending from said holder, latch trip means on said support means for engaging said latch means so as to actuate said latch means when said holder is adjacent to said second location so that when said holder is adjacent to said second location said door is capable of opening so that an article held in said holder will fall out of the bottom of said holder onto said second location.

In a preferred embodiment of a toy in accordance with this invention the two different separate transfer mechanisms indicated in the preceding discussion are utilized in conjunction with one another with the holder on the second of the two mechanisms being mounted upon an arm attached to the shaft of the first of the two mechanisms so that the holder will continuously rotate as the shaft in the first mentioned mechanism rotates. Further, the second of the two mechanisms is located relative to the first so that an article such as a "ball people" type figurine is conveyed as the two mechanisms are operated together from the first to the second location of the first mechanism and then to the first of the second location of the second mechanism.

BRIEF DESCRIPTION OF THE DRAWINGS

The invention is best more fully explained with reference to the accompanying drawings in which.

Figure 1:
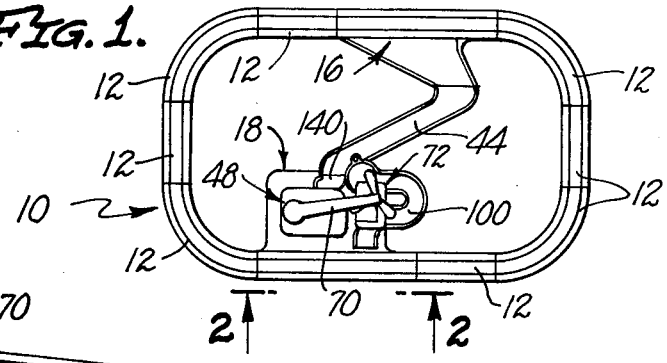
FIG. 1 is a top plan view of a presently preferred embodiment or form of a toy in accordance with this invention; this view does not show a vehicle or a figurine as employed with the toy.
Figure 2:
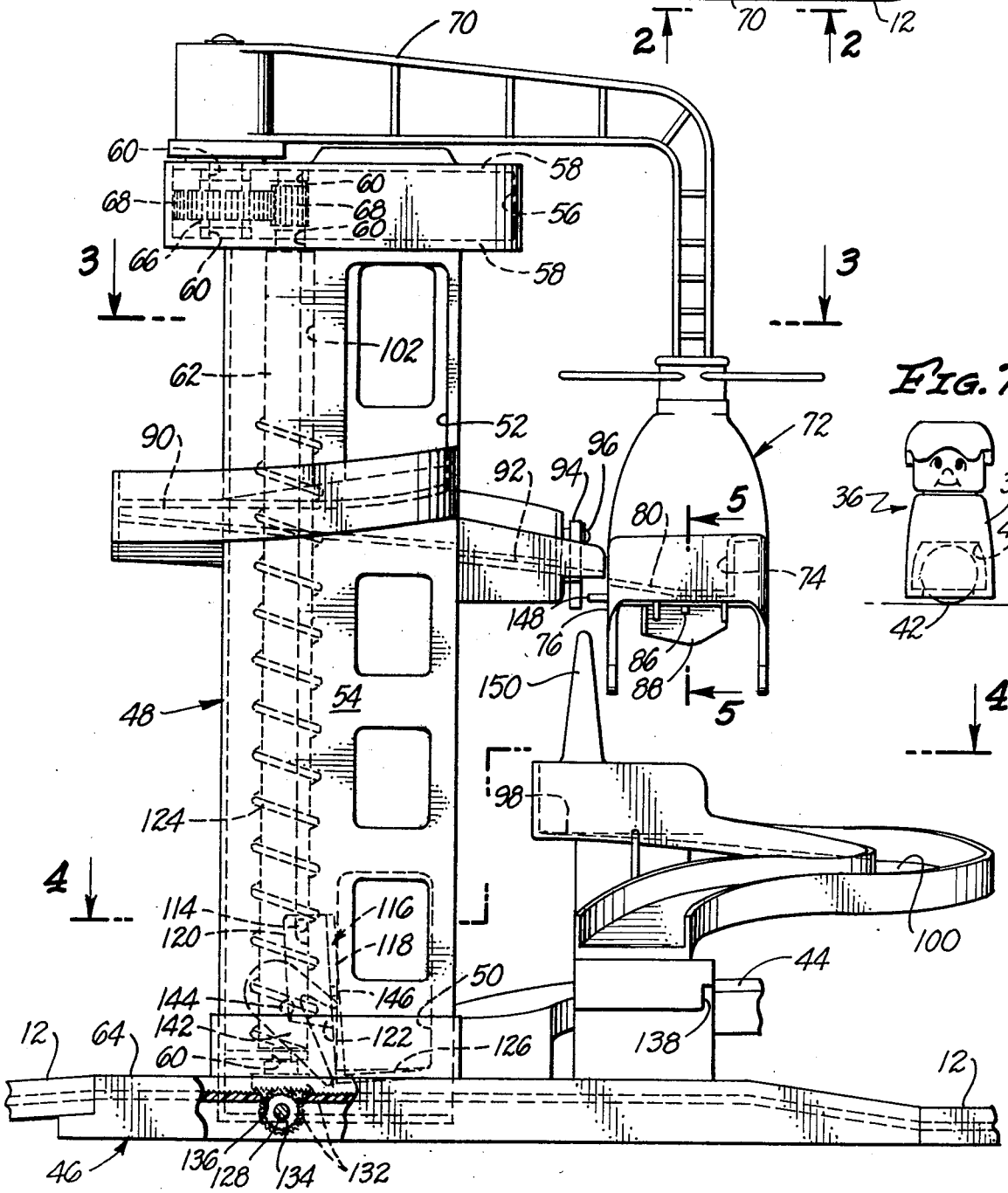
FIG. 2 is an enlarged side-elevational view taken at line 2—2 of FIG. 1 showing a composite transfer mechanism in accordance with the present invention.
Figure 7:
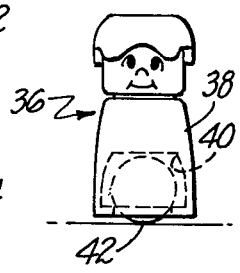
FIG. 7 is a front elevational view of a "ball people" figurine intended to be used with the toy illustrated in the preceding figures.
Figure 3:
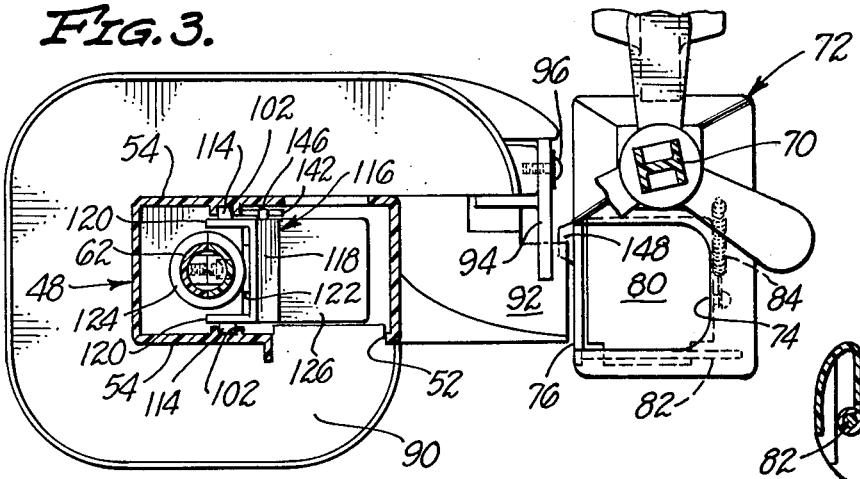
FIG. 3 is a cross-sectional view taken at line 3—3 of FIG. 2.
Figure 5:
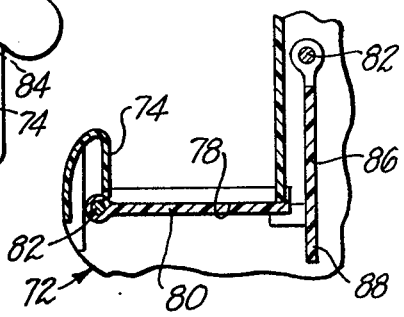
FIG. 5 is a partial cross-sectional view taken at line 5—5 of FIG. 2.
Figure 4:
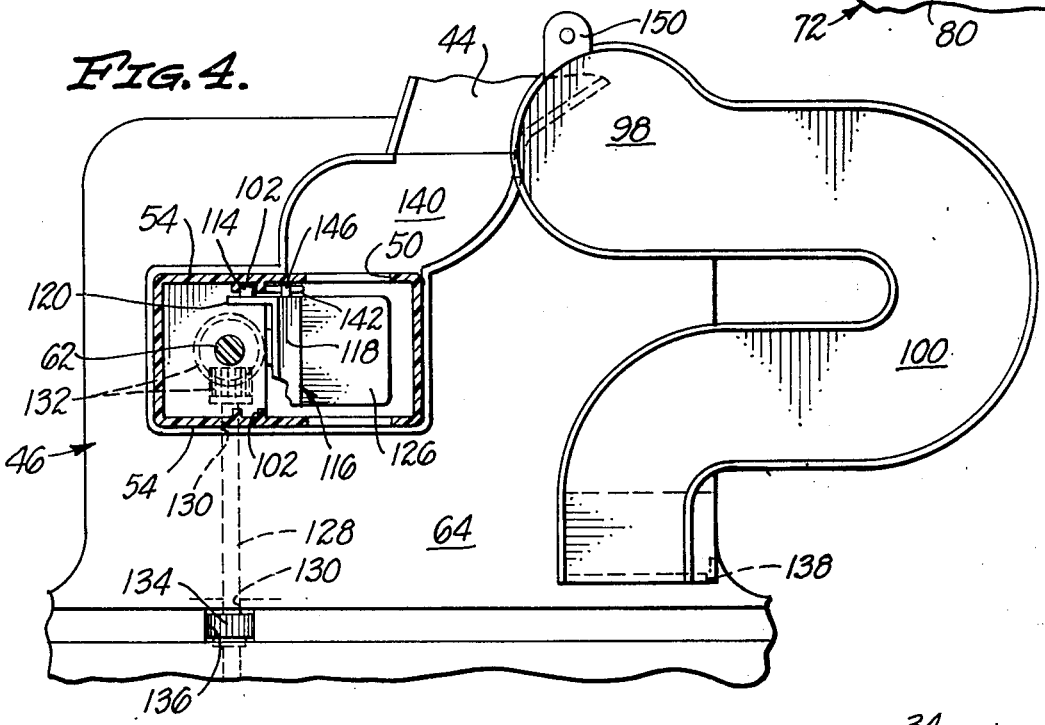
FIG. 4 is a cross-sectional view taken at line 4—4 of FIG. 2.
Figure 6:
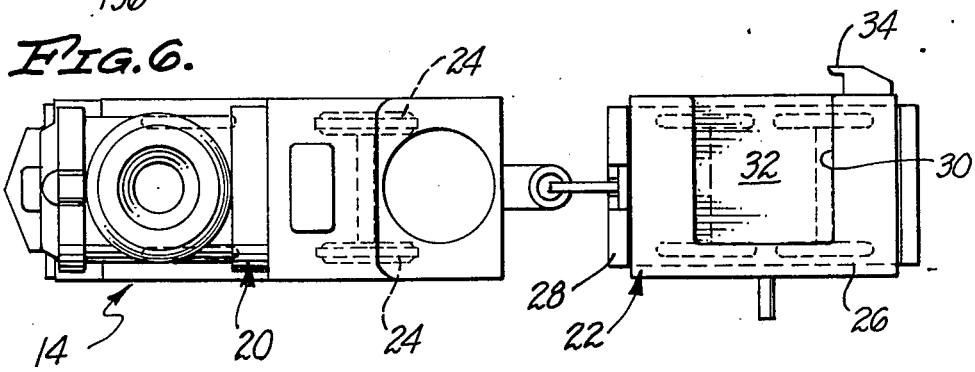
FIG. 6 is a top plan view of a vehicle—specifically a simulated train engine and coal car—preferably employed with the structure illustrated in the preceding figures.

It is to be realized that the operative concepts or principles of the invention set forth and defined in the appended claims forming a part of this specification can be utilized in a number of differently appearing and differently constructed devices through the use and exercise of routine engineering skill. For this reason the invention is not to be considered as being limited to a precise structure as illustrated in the drawing.

DETAILED DESCRIPTION

In the drawings there is shown a complete toy 10 which utilizes a plurality of track sections 12 for the purpose of controlling the motion of a small vehicle 14 so that this vehicle 14 can move in an endless path between an unloading station 16 and a loading station 18.

The particular vehicle 14 used with the toy 10 illustrated includes a simulated locomotive engine 20 and an attached coal car 22. The engine 20 is provided with a known electric motor (not shown) for propelling drive wheels 24. The coal car 22 includes a body 26 which is movably mounted with respect to the frame 28 of the car 22. This body 26 includes a side opening cavity 30 having a sloping bottom 32 which slopes downwardly toward the interior of the body 26. A small catch 34 is mounted on the body 26 so as to extend therefrom.

The particular toy 10 is intended to be utilized in connection with one or more "ball people" type figurines 36, each of which is constructed so as to include a body 38 having a hollow bottom cavity 40 within which there is retained a rotatable ball 42 serving to support the body 38 in such a manner that the figurine 36 can be moved through the action of gravity along an inclined surface. In the toy 10 as in other prior toys the vehicle 14 is adapted to be utilized in transporting the figurine 36 from the loading station 18 to the unloading station 16. At the unloading station 16 the body 26 is moved with respect to the frame 28 so as to make it possible for the action of gravity to move the figurine 36 off the coal car 22 onto an inclined ramp 44 which conveys the figurine 36 to the loading station 18. With the toy 10 a vehicle 14 which has been unloaded in this manner continues to move until it is opposite the loading station 18 where the figurine is transferred back on to the vehicle 14.

The various parts of the toy 10 discussed in the preceding have been described in a generalized manner in order to indicate the "basic" operation of the toy 10. The various parts of the toy 10 indicated in the preceding have not been specifically described in detail since with the exception of the loading station 18 these parts have been utilized in various prior toys such as are indicated in the co-pending applications mentioned early in this specification. In effect the loading station 18 can be regarded as a composite transfer mechanism because of its function in transferring a figurine 36 from the ramp 44 onto the body 26 of the coal car 22.

This loading station 18 includes a flat base 46 supporting an upstanding generally tubular tower 48 having a bottom inlet opening 50 and an upper outlet opening 52. If desired these openings 50 and 52 may be referred to as first and second openings, respectively. They are located on opposite sides 54 of the tower 48. This tower 48 includes a top gear chamber 56 having opposed walls 58. These walls 58 are provided with bearing openings 60 for the purpose of supporting a principal shaft 62 so that this shaft 62 extends upwardly through the tower 48 from the base 46 and through the gear chamber 56. This shaft 62 is also supported by another bearing opening 60 in an upper wall 64 of the base 46 so as to extend a short distance beneath this wall 64. Within the gear chamber 56 there is also located a second shaft 66 which extends upwardly through one of the openings 60 out of and above the tower 48. Conventional spur gears 68 connect the shafts 62 and 66.

The shaft 66 carries an elongated bell crank shaped arm 70 which in turn carries a holder 72 simulating in appearance a toy helicopter. This holder 72 is provided with a cavity 74 roughly corresponding to the cavity 30 leading from one of its sides 76. A bottom opening 78 leads through the holder 72 from within the cavity 74. Normally this opening 78 is closed by a trap door 80 mounted upon a pivot pin 82 connecting it to the holder 72. A small spring 84 serves to bias the door 80 so that it closes off this opening 78 under normal circumstances. Normally the door 80 is restrained against opening by means of a latch 86 mounted by another pivot pin 82. This latch 86 operates in the manner of a conventional gravity operated latch and is provided with a downwardly extending end 88 which is adapted to be engaged so as to move the latch 86 so that the door 80 can be opened.

An inclined chute 90 is mounted on the tower 48 so as to extend generally around the tower 48 from adjacent to the opening 52 to a terminal end 92 of this chute 90. This end 92 is normally blocked off by means of a bell crank shaped stop lever 94 secured to the chute 90 by a pivot 96. The weight of this lever 94 is distributed so that normally the lever 94 will extend generally across at least a portion of the end 92 and will extend downwardly from the chute 90 adjacent to the end 92 through the action of gravity. This lever 94 is mounted so that it is capable of being pivoted so that it does not any longer tend to block off the end 92.

If desired, the portion of the chute 90 adjacent to the outlet opening 52 may be considered as a first location and the end 92 of the chute 90 may be considered as a second location because of the manner in which a figurine 36 is received on and transported along the chute 90 during the operation of the toy 10. This end 92 is located adjacent to and directly above the upper end 98 of a second ramp 100 which is designed to convey a figurine 36 generally off of and away from the unloading station 18.

The unloading station 18 also includes a pair of parallel, aligned slots 102 within the tower 48 on the interiors of the sides 52. These slots 102 restrain axles 114 on a carrier 116 in such a manner that the carrier 116 is capable of being moved and/or of moving within the tower 48 along the shaft 62. This carrier 116 includes a generally vertical wall 118 having ears 120 upon which the axles 114 are mounted. This wall 118 also carries a projection 122 which is shaped so as to correspond to a part of the thread 124 on the shaft 62. The wall 118 also carries a bottom 126 which is sloped downwardly away from the inlet opening 50 generally toward the outlet opening 52.

It will be noted that with this construction the carrier 116 is mounted through the use of the slots 102 and the axles 114 in such a manner that it can be pivoted relative to the shaft 62 so as to disengage the projection 122 from the thread 124. It will also be noted that the slots 102 and the axles 114 mount the carrier 116 so that it can be moved linearly generally parallel to the shaft 62. Because of the operation of these slots 102 and the axles 114 they may be referred to as cooperating guide means on the tower 48 and on the carrier 116 for holding the carrier 116 adjacent to the shaft 62 so that the carrier 116 can be elevated along the length of the shaft 62 and so that this carrier 116 can be pivoted with respect to the shaft 62 at any position it may have along the length of the shaft 62.

During the operation of the toy 10 the shaft 62 is adapted to be rotated in a known manner through the use of the vehicle 14. In order to accomplish this a drive shaft 128 is mounted on bearings 130 beneath the wall 64 and is coupled to the shaft 62 by means of coacting crown and spur gears 132. Gear-like friction wheels 134 are mounted on the shaft 128 so as to extend through openings 136 in the wall 64 in alignment with the track sections 12. These openings 136 are positioned relative to the length of the vehicle 14 so that the catch 34 will engage a downward directed notch 138 located adjacent to the ramp 100 in order to hold the vehicle 14 so that the wheels 24 are in contact with the wheels 134 when the vehicle 14 moves so as to be located at the loading station 18.

During the operation of the toy 10 when the vehicle 14 is at the unloading station 16 the figurine 36 is removed from the vehicle 14 so that it will move through the action of gravity down the ramp 44 onto an inclined inlet surface 140 on the base 46 of the loading station 18. There the figurine 36 may be stopped by engagement with another stop lever 142 reasonably corresponding to the stop lever 94. This lever 142 is generally of a bell crank type shape and is mounted on the tower 48 by means of a pivot 144 in such a manner that its weight is distributed so that it will normally tend to block off the inlet opening 50 except when the carrier 116 is in a position generally adjacent to the opening 50. When the carrier 116 is in such a position a small arm 146 on the wall 118 engages the lever 142 so as to push the lever 142 generally away from the opening. Normally the carrier 116 will be located adjacent the opening 50 so that a figurine 36 moving down the ramp 44 will automatically move onto the bottom 126 of this carrier 116 at about the same time that the vehicle 14 moves onto the loading station 18. When the vehicle 14 reaches the loading station 18 it will be stopped by engagement of the catch 34 with the notch 138 and will thereafter rotate the wheels 134 so as to cause both the shafts 128, 62 and 66 to rotate. This will, of course, result in rotation of the holder 72. If a figurine 36 is supported on the bottom 126 of the carrier 116 as the shaft 62 is rotated the weight of the figurine 36 will tend to pivot the carrier 116 about the axles 114 so as to hold the projection 122 in contact with the thread 124. Such engagement will cause the carrier 116 to move upwardly within the tower 48.

As the carrier 116 moves in this manner the figurine 36 will be restrained on the carrier 116 because the bottom 126 fits closely within the interior of the tower 48 so as to prevent the figurine 36 from moving off the carrier 116. When, however, the carrier 116 reaches a position adjacent to the opening 52 the slope on the bottom 126 will enable the figurine 36 to move by the action of gravity onto the chute 90 and then along the chute 90 to the end 92. There the figurine 36 will normally be stopped by engagement with the lever 94 until such time as the holder 72 moves to a position at which a small projection 148 on this holder 72 engages the lever 94 so as to pivot it out of the way. On occasion the figurine 36 may reach the end 92 when the holder 72 is in a position such that the lever 94 is "open".

When the holder 72 is located so that the lever 94 is in this open position the holder 72 will be located so that the action of gravity will enable the figurine 36 to move through the action of gravity into the cavity 74 onto the door 80 before the holder 72 has rotated generally past the end 92. As the holder 72 further rotates around the tower 48 the end 88 of the latch 86 will be engaged by a pylon 150 located adjacent to the upper end 98 of the ramp 100. This will cause the latch 86 to move so as to disengage the door 80. The weight of the figurine 36 will then serve to open this door 80 so as to deposit the figurine 36 on the chute 100. Thereafter, the figurine 36 will move down the chute 100 onto the bottom 32 of the cavity 30 of the coal car 22. The weight of the figurine 36 will then cause movement of the body 26 relative to the frame 28 in a known manner so as to release the catch 34. Thereafter, the vehicle 14 will automatically move to the unloading station 16.

When the figurine 36 moves off the carrier 116 the weight of this figurine 36 will no longer tend to pivot the carrier 116 about the axles 114 so as to hold the projection 122 in what may be regarded as "reasonable" contact with the thread 124. Thereafter, the movement of the shaft 62 and/or the normal vibration resulting from the operation of the loading station 18 will tend to jar the carrier 116 to a sufficient extent that this carrier 116 pivots slightly about the axles 114 generally away from the shaft 62. As this occurs the axles 114 will slide within the slots 112 as the carrier 116 moves downwardly in what may be loosely described as a "bouncing" manner until such time as the carrier 116 reaches the bottom of the tower 48. This mode of operation requires that reasonable consideration be given to the weight of a figurine 36 and to the weight of the carrier 116 so that the carrier 116 by itself will not advance upwardly along the shaft 62, but so that it will advance along the shaft as additional weight is supported by it.

The complete structure indicated in the preceding in effect constitutes two different transfer mechanisms. The first of these has as its principal parts the shaft 62, the carrier 116, and the tower 48. This first mechanism is employed in the toy 10 in order to elevate the figurine 36 so that it may be moved by what in effect is a second transfer mechanism. This second mechanism includes the chute 90, the holder 72, and various associated parts as are indicated in the preceding. It is, of course, used to transport the figurine 36 from adjacent to the opening 52 to the chute 90. In the toy 10 these two mechanisms are combined together in such a manner that there is a unique, effective interaction which is considered to be quite effective in achieving desired play value.

I claim:

1. A transfer mechanism for use in moving an article from a first location to a second location which comprises:

a base, an externally threaded shaft rotatably mounted on said base so as to extend upwardly therefrom, a tower supported on said base so as to extend upwardly therefrom adjacent to said shaft, a carrier for holding said article and for supporting said article as it is moved from said first location to said second location, cooperating guide means on said tower and on said carrier for controlling movement so that during rotation of said shaft said carrier can be elevated along the length of said shaft and can be pivoted with respect to said shaft, said carrier including a thread like projection capable of fitting against the thread on said shaft, the weight of said carrier being distributed so that said carrier can pivot generally away from said shaft in order to enable said projection to slide downwardly over said thread on said shaft when there is no weight on said carrier and so that said carrier will pivot generally toward said shaft so as to hold said projection in engagement with said shaft when said article is located on said carrier, and power transmission means for use in rotating said shaft operatively connected to said shaft.

2. A transfer mechanism as claimed in claim 1 wherein:

said cooperating guide means comprise rail means for guiding said carrier located on said tower and pivotal support means located on said carrier and engaging said rail means.

3. A transfer mechanism as claimed in claim 1 wherein:

said tower is a hollow tower located around said shaft, said tower having a first opening leading into its interior adjacent to said base and a second opening leading from its interior above said base, said carrier is capable of being moved between positions adjacent to said openings so that said article can be loaded on and removed from said carrier at said positions.

4. A transfer mechanism as claimed in claim 3 wherein:

said cooperating guide means comprise two separate, spaced, parallel grooves on the interior of said tower and two axles on said carrier, each of said axles extending into and being slidable within one of said grooves.

5. A transfer mechanism as claimed in claim 3 wherein:

said carrier includes a platform for carrying said article, said platform being inclined relative to said tower so as to lead from the side of said tower in which said first opening is located toward the side of said tower in which said second opening is located, said first and said second openings are located on opposed sides of said tower, said carrier and said platform fitting relative to the interior of said tower so as to hold said article on said platform by engagement with the interior of said tower when said carrier is intermediate said positions adjacent to said openings.

6. A transfer mechanism as claimed in claim 1 wherein:

said tower is a hollow tower located around said shaft, said tower having a first opening leading into its interior adjacent to said base and a second opening leading from its interior above said base, said carrier is capable of being moved between positions adjacent to said openings so that said article can be loaded on and removed from said carrier at said positions, said cooperating guide means comprise two separate, spaced, parallel grooves on the interior of said tower and two axles on said carrier, each of said axles extending into and being slidable within one of said grooves, said carrier includes a platform for carrying said article, said platform being inclined relative to said tower so as to lead from the side of said tower in which said first opening is located toward the side of said tower in which said second opening is located, said first and said second openings are located on opposed sides of said tower, said carrier and said platform fitting relative to the interior of said tower so as to hold said article on said platform by engagement with the interior of said tower when said carrier is intermediate said positions adjacent to said openings, and including inclined chute means for conveying said article from said second opening onto said chute means, said chute means having an end, an arm rotatably mounted on said tower, said arm being operatively connected to said shaft so as to rotate when said shaft rotates, a holder means for carrying said article attached to said arm so as to rotate therewith, said holder means passing adjacent to the end of said chute means during its rotation, door means for removing said article when said article is located on said holder outwardly through the bottom of said holder, gate means adjacent to said end of said chute for closing off said end of said chute means, actuator means for opening said gate means located on said holder for opening said gate means when said holder is adjacent to said end of said chute, and wherein said door means comprises automatically closing trap door means located in the bottom of said holding means, latch means for engaging said trap door means, and including engagement means on said base for engaging said latch means so as to permit opening of said trap door means.

7. A transfer mechanism for use in moving an article from a first location to a second location which comprises:

support means, a holder movably mounted on said support means so as to be capable of being moved from adjacent to said first location to said second location, said holder being capable of receiving said article when adjacent to said first location, a bottom door located on said holder, latch means located on said holder for use in controlling when said door can be opened, said latch means extending from said holder, latch trip means on said support means for engaging said latch means so as to permit said door to be opened when said holder is adjacent to said second location so that an article held in said holder will fall out of the bottom of said holder onto said second location.

8. A transfer mechanism as claimed in claim 7 wherein:

said bottom door is a spring loaded door which automatically closes.

9. A transfer mechanism as claimed in claim 7 wherein:

said holder is rotatably supported so as to rotate around said support means.

10. A transfer mechanism for use in moving an article from a first location to a second location which comprises:

a base, an externally threaded shaft rotatably mounted on said base so as to extend upwardly therefrom, a hollow tower located around said shaft, said tower having a first opening leading into its interior adjacent to said base and a second opening leading from its interior above said base, said openings being located on opposite sides of said tower, a carrier for holding said article and for supporting said article as it is moved from said first location to said second location, cooperating guide means on said tower and on said carrier for controlling movement so that during rotation of said shaft said carrier can be elevated along the length of said shaft and can be pivoted with respect to said shaft, said carrier being capable of being moved between positions adjacent to said openings so that said article can be loaded on and removed from said carrier at said positions, said carrier including a thread like projection capable of fitting against the thread on said shaft, said carrier including a platform for carrying said article, said platform being inclined relative to said tower so as to lead from the side of said tower in which said first opening is located toward the side of said tower in which said second opening is located, said carrier and said platform fitting relative to the interior of said tower so as to hold said article on said platform by engagement with the interior of said tower when said carrier is intermediate said positions adjacent to said openings, the weight of said carrier being distributed so that said carrier can pivot generally away from said shaft in order to enable said projection to slide downwardly over said thread on said shaft when there is no weight on said carrier and so that said carrier will pivot generally toward said shaft so as to hold said projection in engagement with said shaft when said article is located on said carrier, and power transmission means for use in rotating said shaft operatively connected to said shaft, inclined chute means for conveying said article from said second opening, said chute means having an end, an arm rotatably mounted on said tower, said arm being operatively connected to said shaft so as to rotate when said shaft rotates, a holder means for carrying said article attached to said arm so as to rotate therewith, said holder means passing adjacent to the end of said chute means during its rotation, door means for removing said article when said article is located on said holder outwardly through the bottom of said holder.

11. A transfer mechanism as claimed in claim 10 wherein:

gate means adjacent to said end of said chute for closing off said end of said chute means, actuator means for opening said gate means located on said holder for opening said gate means when said holder is adjacent to said end of said chute, and wherein, said door means comprises automatically closing trap door means located in the bottom of said holding means, latch means for engaging said trap door means, and including engagement means on said base for engaging said latch means so as to permit opening of said trap door means.

12. A transfer mechanism as claimed in claim 10 including:

gate means adjacent to said end of said chute for closing off said end of said chute means, actuator means for opening said gate means located on said holder for opening said gate means when said holder is adjacent to said end of said chute.

13. A transfer mechanism as claimed in claim 10 wherein:

said door means comprises automatically closing trap door means located in the bottom of said holding means, latch means for engaging said trap door means to prevent opening thereof, and including engagement means on said base for engaging said latch means so as to permit opening of said trap door means.

* * * * *